US009581373B2

(12) United States Patent
Lin et al.

(10) Patent No.: US 9,581,373 B2
(45) Date of Patent: Feb. 28, 2017

(54) ICE MAKER WITH SELF-REGULATING ICE MOLD AND METHOD OF OPERATING SAME

(75) Inventors: Yen Hsi Lin, St. Joseph, MI (US); Cristian A. Soto, Three Oaks, MI (US); Andrew M. Tenbarge, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1204 days.

(21) Appl. No.: 13/421,909

(22) Filed: Mar. 16, 2012

(65) Prior Publication Data

US 2013/0239594 A1 Sep. 19, 2013

(51) Int. Cl.
*F25C 5/08* (2006.01)
*F25C 1/04* (2006.01)

(52) U.S. Cl.
CPC ..... *F25C 5/08* (2013.01); *F25C 1/04* (2013.01); *F25C 2600/02* (2013.01); *F25C 2600/04* (2013.01); *F25C 2700/14* (2013.01)

(58) Field of Classification Search
CPC ..... F25C 5/08; F25C 2700/14; F25C 5/02
See application file for complete search history.

(56) References Cited

U.S. PATENT DOCUMENTS 4,727,720 A 3/1988 Wernicki
5,042,263 A 8/1991 Day et al.
5,582,754 A * 12/1996 Smith et al. ..... 219/438
5,722,244 A 3/1998 Shelton
5,884,490 A 3/1999 Whidden
6,082,780 A 7/2000 Rowley et al.
7,152,424 B2 * 12/2006 Shoukyuu et al. ..... 62/351
7,540,161 B2 6/2009 Broadbent et al.
2005/0067406 A1 3/2005 Rajarajan
2007/0101753 A1 5/2007 Broadbent
2008/0116424 A1 * 5/2008 Bandyopadhyay ..... C08K 3/08 252/513
2009/0049858 A1 * 2/2009 Lee ..... F25C 1/08 62/349
2009/0187280 A1 * 7/2009 Hsu et al. ..... 700/275
2009/0235682 A1 * 9/2009 Petrenko et al. ..... 62/351
2010/0018226 A1 * 1/2010 Kim et al. ..... 62/73
2010/0218520 A1 9/2010 McCollough et al.
2012/0036872 A1 * 2/2012 Junge et al. ..... 62/73

OTHER PUBLICATIONS

Wang et al, Electrical behavior of carbon fiber polymer-matrix composites in the through-thickness direction, Journal of Materials Science (2000), 91-100.*

* cited by examiner

*Primary Examiner* — Elizabeth Martin

(57) ABSTRACT

An ice maker of a domestic refrigerator that includes an ice mold having an electrically-conductive polymeric body and a plurality of cavities defined in the polymeric body. Each cavity is sized to receive a quantity of fluid corresponding to a single ice cube. A pair of electrodes is engaged with a bottom surface of the polymeric body. The polymeric body has a first electrical conductivity at a first operating temperature and a second electrical conductivity that is less than the first electrical conductivity at a second operating temperature. The second operating temperature is greater than the first operating temperature.

18 Claims, 5 Drawing Sheets

ICE MAKER WITH SELF-REGULATING ICE MOLD AND METHOD OF OPERATING SAME

TECHNICAL FIELD

The present disclosure relates generally to a domestic refrigerator and more particularly to an ice maker for a domestic refrigerator.

BACKGROUND

A domestic refrigerator is a device that is used to store food items in a home at preset temperatures. A domestic refrigerator typically includes one or more temperature-controlled cavities into which food items may be placed to preserve the food items for later consumption. A domestic refrigerator also typically includes a door that permits user access to the temperature-controlled cavity, and many domestic refrigerators also include an ice maker to produce ice for consumption.

SUMMARY

According to one aspect of the disclosure, an ice maker of a domestic refrigerator is disclosed. The ice maker includes an ice mold and a pair of electrodes. The ice mold includes an electrically-conductive polymeric body having a convex bottom surface and a plurality of cavities defined in the polymeric body. Each cavity is sized to receive a quantity of fluid corresponding to a single ice cube. The pair of electrodes is engaged with the convex bottom surface of the polymeric body, and the electrodes are configured to be electrically-coupled to an electrical power supply. The pair of electrodes and the polymeric body define an electrical circuit such that electrical current flows through the polymeric body when the power supply is electrically-coupled to the electrodes to heat the polymeric body. The polymeric body has a first electrical conductivity at a first operating temperature, and the polymeric body has a second electrical conductivity that is less than the first electrical conductivity at a second operating temperature. The second operating temperature is greater than the first operating temperature.

In some embodiments, the polymeric body may have a longitudinal axis extending therethrough, and the convex bottom surface of the polymeric body has a first surface section positioned on a first side of the longitudinal axis and a second surface section positioned on a second side of the longitudinal axis. The pair of electrodes may include a first electrode coupled to the first surface section of the convex bottom surface and a second electrode coupled to the second surface section of the convex bottom surface.

In some embodiments, the first electrode may include a first plurality of curved plates shaped to conform to the convex bottom surface of the polymeric body of the ice mold, and the second electrode may include a second plurality of curved plates shaped to conform to the convex bottom surface of the polymeric body of the ice mold. Additionally, in some embodiments, the pair of electrodes may be formed from copper. In some embodiments, the pair of electrodes may be ultrasonically welded to the convex bottom surface of the polymeric body.

Additionally, in some embodiments, the ice maker may further include a panel positioned below the pair of electrodes. The panel may have a convex body sized to substantially cover the convex bottom surface of the polymeric body of the ice mold. In some embodiments, the panel may include a plurality of slots sized to permit passage of air.

In some embodiments, the second electrical conductivity is equal to approximately zero siemens per meter. In some embodiments, the second operating temperature is between about 130° F. and 150° F.

According to another aspect, an ice maker of a domestic refrigerator includes an ice mold, a first copper electrode, and a second copper electrode. The ice mold includes an electrically-conductive polymeric body having a bottom surface, and a plurality of cavities defined in the polymeric body. Each cavity is sized to receive a quantity of fluid corresponding to a single ice cube. The first copper electrode is coupled to the bottom surface of the polymeric body and includes a first plurality of plates shaped to conform to the bottom surface. The second copper electrode is coupled to the bottom surface of the polymeric body, and includes a second plurality of plates shaped to conform to the bottom surface. The first copper electrode, the second copper electrode, and the polymeric body define an electrical circuit such that electrical current flows through the polymeric body when power is supplied to the electrical circuit to heat the polymeric body and release ice cubes formed therein. The polymeric body has a first electrical conductivity at a first operating temperature, and the polymeric body has a second electrical conductivity that is less than the first electrical conductivity at a second operating temperature. The second operating temperature being greater than the first operating temperature.

In some embodiments, the polymeric body may have a longitudinal axis extending therethrough that is positioned between the first copper electrode and the second copper electrode. In some embodiments, the ice maker may include a tube in fluid communication with a fluid reservoir. The tube may have an outlet positioned above the polymeric body. The polymeric body of the ice mold may include an upper surface having the plurality of cavities defined therein, and a housing having a first opening positioned below the outlet of the tube and a second opening position above the upper surface such that fluid from the fluid reservoir is advanced to the plurality of cavities.

In some embodiments, the ice maker may include a panel positioned below the first copper electrode and the second copper electrode. The panel may be sized to substantially cover the bottom surface of the polymeric body of the ice mold. In some embodiments, the panel may include a plurality of slots sized to permit passage of air.

In some embodiments, the first plurality of plates of the first copper electrode and the second plurality of plates of the second copper electrode may correspond to the plurality of cavities defined in the polymeric body of the ice mold.

According to another aspect, a method of operating an ice maker for a domestic refrigerator is disclosed. The method includes supplying fluid to an electrically-conductive polymeric body such that fluid is received in at least one cavity defined in the polymeric body, and increasing an operating temperature of the polymeric body after at least one ice cube is formed in the at least one cavity to release the at least one ice cube from the polymeric body. Increasing the operating temperature includes supplying electrical current to the polymeric body such that electrical current passes through the polymeric body from a first electrode secured to a first surface of the polymeric body to a second electrode secured to the first surface of the polymeric body. The method also includes extracting at least one ice cube from at least one cavity of the polymeric body. The polymeric body has a first electrical conductivity at a first operating temperature, and the polymeric body has a second electrical conductivity that is less than the first electrical conductivity at a second operating temperature. The second operating temperature is greater than the first operating temperature.

In some embodiments, the second electrical conductivity may be equal to approximately zero siemens per meter. Additionally, in some embodiments, the second operating temperature may be between about 130° F. and 150° F.

BRIEF DESCRIPTION OF THE DRAWINGS

The detailed description particularly refers to the following figures, in which.

DETAILED DESCRIPTION OF THE DRAWINGS

Figure 1:
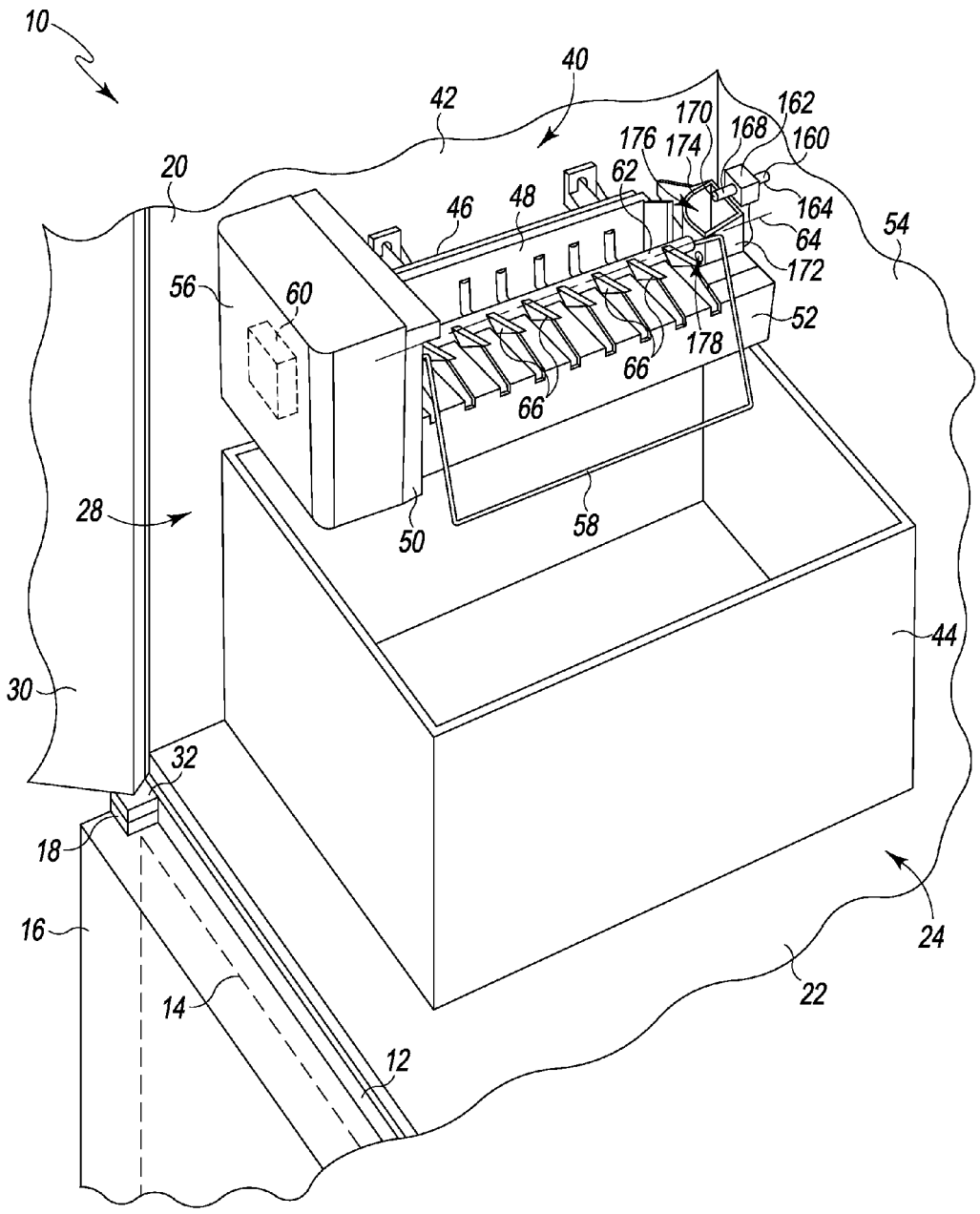
FIG. 1 is a fragmentary perspective view of a domestic refrigerator showing an ice maker positioned therein.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a home appliance is shown as a domestic refrigerator appliance 10 (hereinafter refrigerator 10). One example of a domestic refrigerator is the Whirlpool Top Mount Refrigerator Model No. WRT579SMYW, which is commercially available from Whirlpool Corporation of Benton Harbor, Mich., U.S.A. The refrigerator 10 includes a housing 12 that defines a refrigerated compartment 14 into which a user may place and store food items such as milk, cheese, produce, etcetera. The refrigerated compartment 14 is a temperature-controlled compartment, which is operable to maintain stored food items at a predefined temperature. A door 16 is hinged to the front of the refrigerator housing 12 via a pair of hinge assemblies 18, and the door 16 permits user access to the refrigerated compartment 14 such that food items may be placed in and retrieved from the refrigerator 10. A handle (not shown) is located on a front panel of the door 16, and the user may use the handle to pull the door 16 open.

The refrigerator housing 12 of the refrigerator 10 includes a number of side walls 20 that extend upwardly from a bottom wall 22 to define a freezer compartment 24, which is independently operable to maintain food items stored therein at a certain temperature. The refrigerator housing 12 has an open front side 26 that defines an access opening 28, which provides user access to the freezer compartment 24. A door 30 is hinged to the front of the refrigerator housing 12 via a pair of hinge assemblies 32. The door 30 permits user access to the freezer compartment 24 such that food items may be placed in and retrieved from the refrigerator 10. A handle (not shown) is located on the door 30, and the user may use the handle to pull the door 30 open.

In the illustrative embodiment, the freezer compartment 24 is shown positioned above the refrigerated compartment 14. It will be appreciated that in other embodiments the freezer compartment may be positioned below or side-by-side with the refrigerated compartment 14. It will be further appreciated that in other embodiments the refrigerator 10 may not have a refrigerated compartment.

As shown in FIG. 1, the refrigerator 10 also includes an ice maker 40 configured to form a plurality of ice cubes. The ice maker 40 is positioned in the freezer compartment 24 and is secured to a side wall 42 of the refrigerator 10. An ice storage bin 44 is positioned below the ice maker 40. The storage bin 44 is sized to receive ice cubes formed in the ice maker 40 and is configured to be removed from the freezer compartment 24. It should be appreciated that in other embodiments the refrigerator 10 may also include an ice dispenser configured to dispense ice through one of the doors of the refrigerator 10 while the doors are closed.

The ice maker 40 of the refrigerator 10 includes a frame 46 secured to the side wall 42 and an ice mold 48 secured to the frame 46. The frame 46 has a front end 50 positioned toward the access opening 28 of the freezer compartment 24 and a rear end 52 positioned adjacent the rear interior wall 54 of the refrigerator 10. The ice mold 48 is positioned in a slot (not shown) defined in the frame 46 between the ends 50, 52.

The ice maker 40 includes a control housing 56 that is secured to the front end 50 of the frame 46 and a control arm 58 that is pivotally coupled to the ends 50, 52 of the frame 46. As described in greater detail below, movement of the control arm 58 operates electrical circuitry 60 positioned in the housing 56 to control the ice production cycle of the ice maker 40. The ice maker 40 also includes an ejector arm 62 that is pivotally coupled to the frame 46 and operable to rotate about a longitudinal axis 64. As shown in FIG. 1, the ejector arm 62 includes a plurality of blades 66, which are operable to extract ice cubes formed in the ice maker 40 and advance the extracted ice cubes into the storage bin 44.

Figure 2:
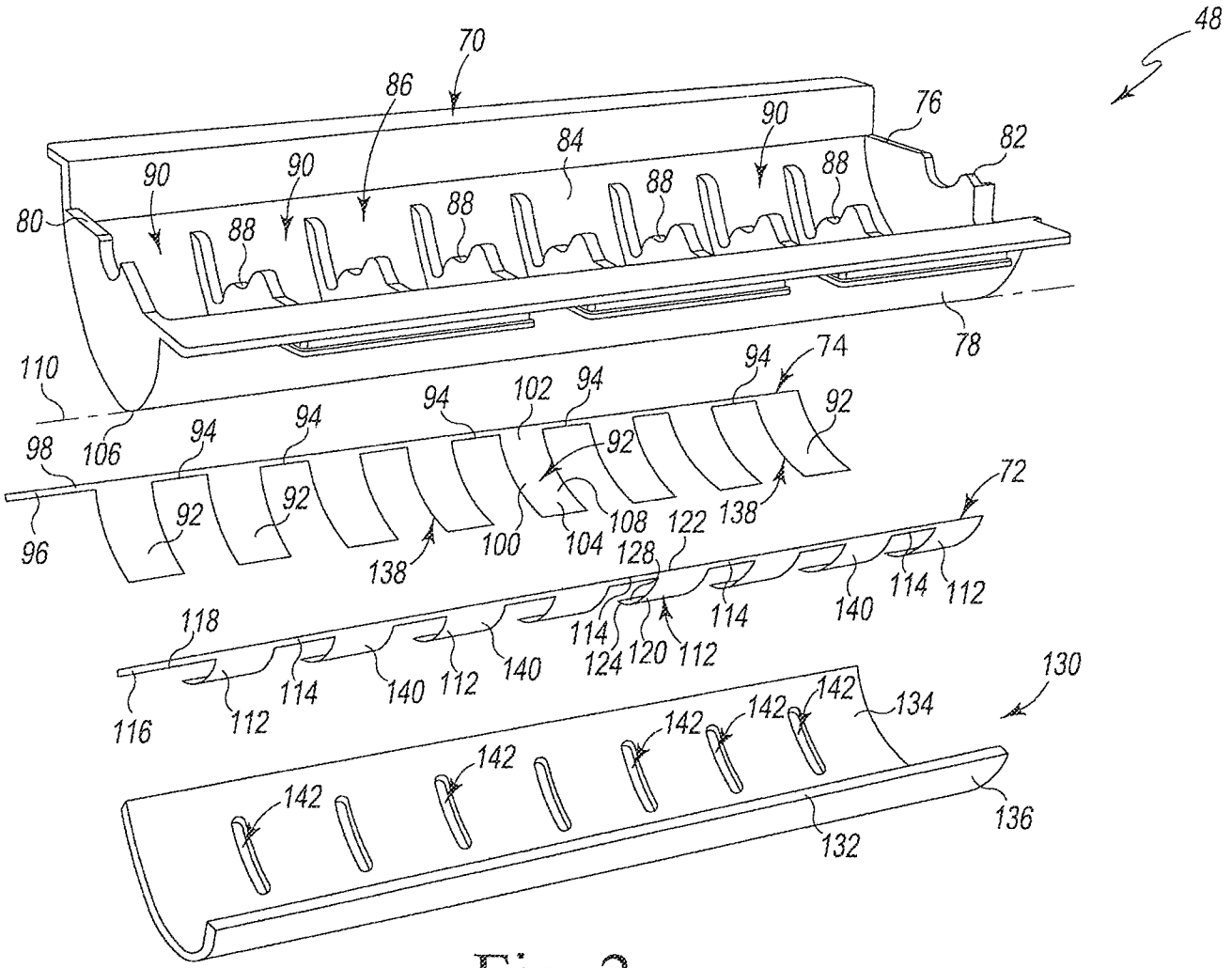
FIG. 2 is an exploded perspective view one embodiment of an ice mold of the ice maker of FIG. 1.

As shown in FIG. 2, the ice mold 48 of the ice maker 40 has a mold body 70 and a pair of electrodes 72, 74 that are secured to the mold body 70. The mold body 70 is formed from a polymeric material having an electrical conductivity that varies with temperature. One example of a polymeric material having conductive properties that vary with temperature is the Stat-Kon compound, which is commercially-available from SABIC Innovative Plastics of Pittsfield, Mass., U.S.A. In the illustrative embodiment, the polymeric material is selected such that the electrical conductivity of the mold body 70 decreases as the temperature of the mold body 70 increases. That is, the mold body 70 is configured to permit less current to flow through the mold body 70 as the temperature of the mold body 70 is increased, as described in greater detail below.

The mold body 70 of the ice mold 48 has an upper surface 76 that is positioned opposite a convex bottom surface 78. It should be appreciated that in other embodiments the bottom surface of the mold body may be substantially planar and may include one or more angled surfaces. The mold body 70 includes a pair of end walls 80, 82 that extend downwardly from the upper surface 76. The mold body 70 also includes a concave inner wall 84 positioned between the end walls 80, 82.

As shown in FIG. 2, the walls 80, 82, 84 define a compartment 86 in the mold body 70. The mold body 70 includes a plurality of divider walls 88 that extend upwardly from the concave inner wall 84 to define a plurality of cavities 90 therein. Each of the cavities 90 is sized to receive a quantity of fluid corresponding to a single ice cube. In the illustrative embodiment, the mold body 70 has eight cavities 90 defined therein. As a result, the mold body 70 can form up to eight ice cubes concurrently.

As described above, the ice mold 48 includes a pair of electrodes 72, 74 that are secured to the bottom surface 78. In the illustrative embodiment, the electrodes 72, 74 are ultrasonically welded to the bottom surface 78. The electrodes 72, 74 are formed from an electrically-conductive metallic material, such as, for example, copper. The electrode 72 includes a plurality of conductor plates 92 and a plurality of rods 94 connecting the plates 92 together. The electrode 72 also includes a terminal 96 extending from one end 98 thereof. The terminal 96 is configured to be electrically-coupled to an electrical power supply, as described in greater detail below.

As shown in FIG. 2, each conductor plate 92 has a body 100 extending from an upper end 102, which is connected to a pair of rods 94, to a lower end 104 that is positioned adjacent to the apex 106 of the bottom surface 78. In the illustrative embodiment, the body 100 has a curved upper surface 108 that is shaped to match the convex shape of the bottom surface 78. The curved upper surface 108 of each conductor plate 92 engages the bottom surface 78 below a corresponding cavity 90 of the mold body 70. In that way, the number of conductor plates 92 included on the electrode 72 corresponds to the number of cavities 90 of the mold body 70.

As shown in FIG. 2, the apex 106 of the convex bottom surface 78 defines a longitudinal axis 110 of the mold body 70. The electrodes 72, 74 are secured to the bottom surface 78 such that the axis 110 is positioned between the electrodes 72, 74. As a result, the electrode 72 is positioned on one side of the axis 110 and the electrode 74 is positioned on the opposite side of the axis 110. The electrode 74, like the electrode 72, includes a plurality of conductor plates 112 that are joined together with a plurality of rods 114. A terminal 116 extends from one end 118 of the electrode 74 and is configured to be electrically-coupled to an electrical power supply.

Each conductor plate 112 of the electrode 74 has a body 120 extending from an upper end 122 connected to a pair of rods 114 to a lower end 124 positioned adjacent to the apex 106 of the bottom surface 78 of the mold body 70. In the illustrative embodiment, the body 120 of each plate 112 has a curved upper surface 128 that is shaped to match the convex shape of the bottom surface 78. Like the electrode 72, the curved upper surface 128 of each conductor plate 112 engages the bottom surface 78 below a corresponding cavity 90 of the mold body 70.

As shown in FIG. 2, the ice mold 48 of the ice maker 40 also includes a cover panel 130 that is secured to the mold body 70. The cover panel 130 is formed from a non-conductive material, such as, for example, polyethylene. The cover panel 130 has a shell 132 including a concave upper surface 134 that is positioned opposite a convex bottom surface 136. The upper surface 134 engages the lower surfaces 138, 140 of the conductor plates 92, 112 of the electrodes 72, 74, respectively. A plurality of slots 142, which extend between the surfaces 134, 136, are defined in the shell 132. The slots 142 are positioned between the conductor plates 92, 112 of the electrodes 72, 74, respectively, of the ice mold 48. Each slot 142 is sized to permit air from the freezer compartment 24 to flow over the electrodes 72, 74.

Figure 3:
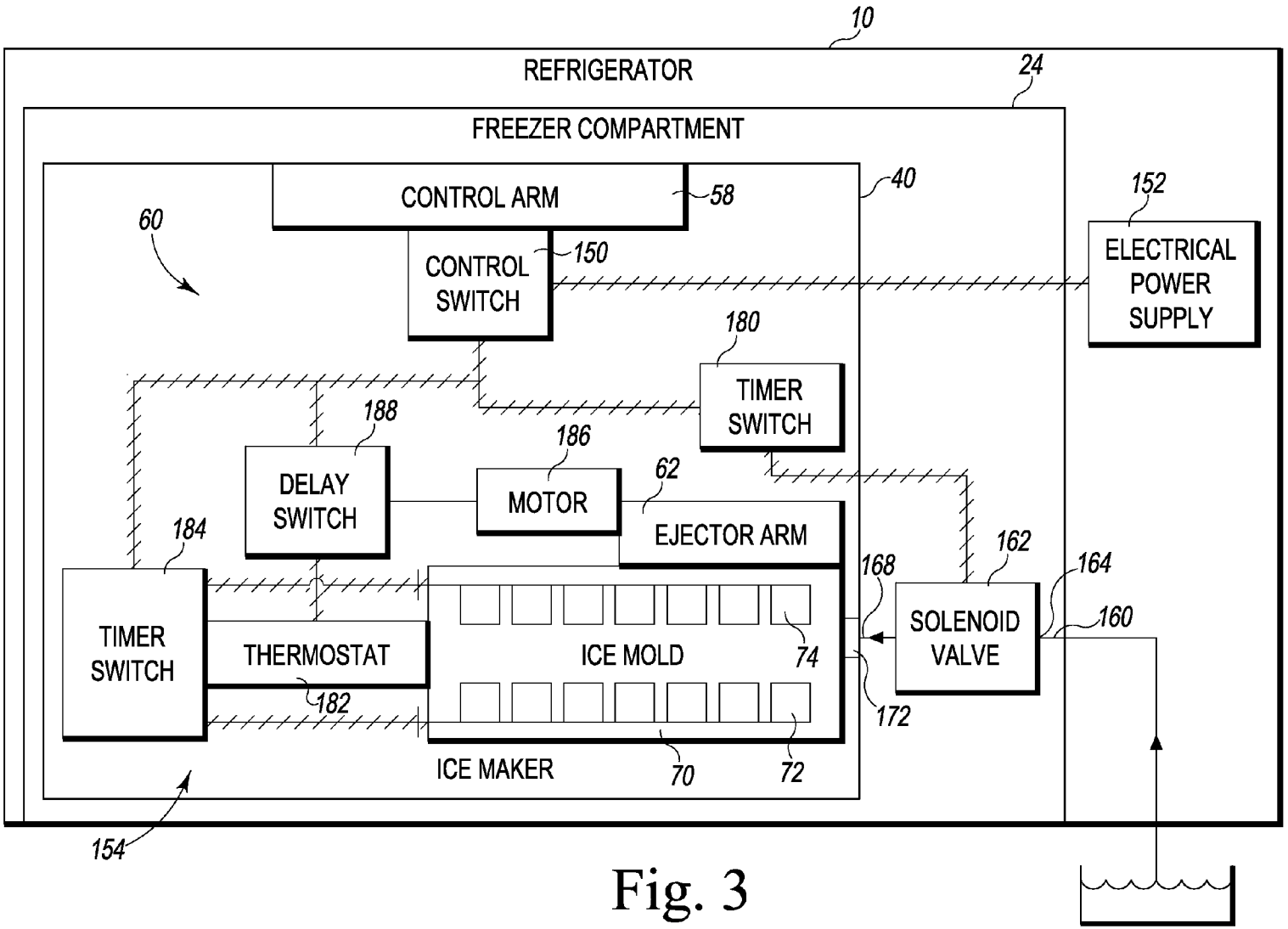
FIG. 3 is a simplified block diagram of the refrigerator of FIG. 1.

Referring now to FIG. 3, the refrigerator 10 and the ice maker 40 are shown in a simplified block diagram. As will be described in greater detail below in reference to FIG. 4, the ice maker 40 has electrical circuitry 60 operable to control the operation of the ice maker 40 to produce ice cubes. In the illustrative embodiment, the circuitry 60 includes a control switch 150 that is operated by the control arm 58. The switch 150 is electrically-coupled to an electrical power supply 152 of the refrigerator 10 and a plurality of other electrical components 154 of the ice maker 40. In the illustrative embodiment, the switch 150 is a mechanical switch that is operable to regulate the power supplied to the other electrical components 154 based on the position of the control arm 58.

The switch 150 of the ice maker 40 is configured to close when the control arm 58 is in the lowered position shown in FIG. 1. When the switch 150 is closed, the power supply 152 of the refrigerator 10 is connected with the other electrical components 154 such that the ice maker 40 executes an ice production cycle. When the control arm 58 is moved away from the lowered position, the switch 150 is configured to open, thereby disconnecting the electrical components 154 of the ice maker 40 from the power supply 152 and deactivating the ice maker 40.

As shown in FIGS. 1 and 3, the refrigerator 10 also includes a fluid line 160 that is coupled to an external water supply. The external water supply may be, for example, the plumbing line of a home or residence. The fluid line 160 extends from the rear interior wall 54 into the freezer compartment 24 of the refrigerator 10. The ice maker 40 includes a solenoid-operated valve 162 that is secured to an end 164 of the fluid line 160. The valve 162 of the ice maker 40 is operable to regulate amount of fluid supplied to the ice mold 48. As shown in FIG. 1, the fluid line 160 is coupled to an inlet of the valve 162, and the refrigerator 10 includes a feed tube 168 that is coupled to the outlet of the valve 162. When the valve 162 is supplied with power, the valve 162 moves to an open position such that fluid may advance from the fluid line 160 to the feed tube 168. When the valve 162 is unpowered, the valve 162 is closed such that fluid is prevented from advancing from the fluid line 160 to the feed tube 168.

As shown in FIG. 1, the feed tube 168 has an outlet 170 that is positioned above a fill housing 172 of the ice maker 40. The fill housing 172 is secured to the rear end 52 of the frame 46 and is sized to receive water from the feed tube 168. The fill housing 172 has an opening 174 positioned below the outlet 170 of the feed tube 168, and a passageway 176 that extends downwardly from the opening 174. An outlet opening 178 is positioned at the bottom of the passageway 176 adjacent to the upper surface 76 of the mold body 70. When the valve 162 is opened, water advances through the outlet 170 of the feed tube 168 into the opening 174 of the housing 172. Water moves down the passageway 176, out of the opening 178, and into the compartment 86 defined in the mold body 70. In that way, the cavities 90 may be filled with water.

Returning to FIG. 3, the ice maker 40 includes a timer switch 180 that is configured to regulate the supply of electrical power to the solenoid-operated valve 162. The timer switch 180 is electrically-coupled to the valve 162 and the control switch 150 and is configured to close when the control arm 58 is placed in the lowered position. As described above, when the control arm 58 is placed in the lowered position, the control switch 150 is closed, thereby permitting electrical power to be supplied to the timer switch 180 and, hence, to the solenoid-operated valve 162.

When supplied with electrical power, the solenoid-operated valve 162 moves to the open position, thereby permitting water to advance from the fluid line 160 to the ice maker 40. The timer switch 180 is configured to remain closed for a predetermined period of time. As described in greater detail below, the predetermined period of time corresponds to the amount of time necessary for water to fill the cavities 90 of the ice maker 40. When the predetermined period of time has elapsed, the switch 180 is configured to open, thereby preventing power from being supplied to the solenoid-operated valve 162. In response to the loss of power, the valve 162 moves to the closed position such that water is prevented from advancing from the fluid line 160.

As shown in FIG. 3, the ice maker 40 also includes a thermostat 182 that is secured to the ice mold 48. The thermostat 182 is operable to monitor the temperature of the fluid in the cavities 90 of the mold body 70. When the temperature of the fluid in the cavities 90 reaches a predetermined value, the thermostat 182 is configured to generate an electrical output signal. In the illustrative embodiment, the predetermined value is a temperature corresponding to fully formed ice cubes. It should be appreciated that the thermostat may be embodied as a bimetallic thermostat or other analog device or may be embodied as a digital device that uses, for example, thermistors to measure temperature.

The ice maker 40 of the refrigerator 10 includes a timer switch 184 that is electrically-coupled to the thermostat 182. As shown in FIG. 3, the timer switch 184 is also positioned between the switch 150 and the electrodes 72, 74 of the ice mold 48. The switch 184 of the ice maker 40 is configured to regulate the supply of electrical power to the ice mold 48 based on the output signal from the thermostat 182. When the thermostat 182 generates the electrical output signal to indicate that ice cubes have formed in the ice mold 48, the switch 184 is configured to close, thereby connecting the ice mold 48 with the power supply 152 of the refrigerator 10 and permitting power to be supplied thereto.

The timer switch 184 is configured to remain closed for predetermined period of time. As described in greater detail below, the predetermined period of time corresponds to the amount of time necessary for the ice cubes in the ice mold 48 to release or loosen from the surfaces defining the cavities 90. When the predetermined period of time has elapsed, the switch 184 is configured to open, thereby disconnecting the ice mold 48 from the power supply 152 and preventing power from being supplied thereto.

As shown in FIG. 3, the ice maker 40 also includes an electric motor 186 operable to rotate the ejector arm 62 about the axis 64. As described above, when the ejector arm 62 is rotated about the axis 64, the blades 66 are advanced into the cavities 90 to push the ice cubes out of the mold body 70. It should be appreciated that in other embodiments the ice maker may include, for example, a mechanical drive mechanism configured to rotate the ejector arm 62 about the axis 64.

The ice maker 40 also includes a time delay switch 188 that regulates the electrical power supplied to the electric motor 186. As shown in FIG. 3, the switch 188 is electrically-coupled to the motor 186 and the thermostat 182. When the thermostat 182 generates the electrical output signal indicating that ice cubes have formed in the ice mold 48, a countdown timer of the switch 188 is activated. When a predetermined period of time has elapsed, the delay switch 188 is configured to close, thereby permitting electrical power to be supplied to the motor 186. The predetermined period of time may be the same as, or greater than, the time necessary for the ice cubes to be released from the mold body 70.

The delay switch 188 of the ice maker 40 is configured to remain closed while the ejector arm 62 completes one revolution about the axis 64. When the ejector arm 62 has completed its revolution, the delay switch 188 is configured to open, thereby disconnecting the motor 186 from the power supply 152.

Figure 4:
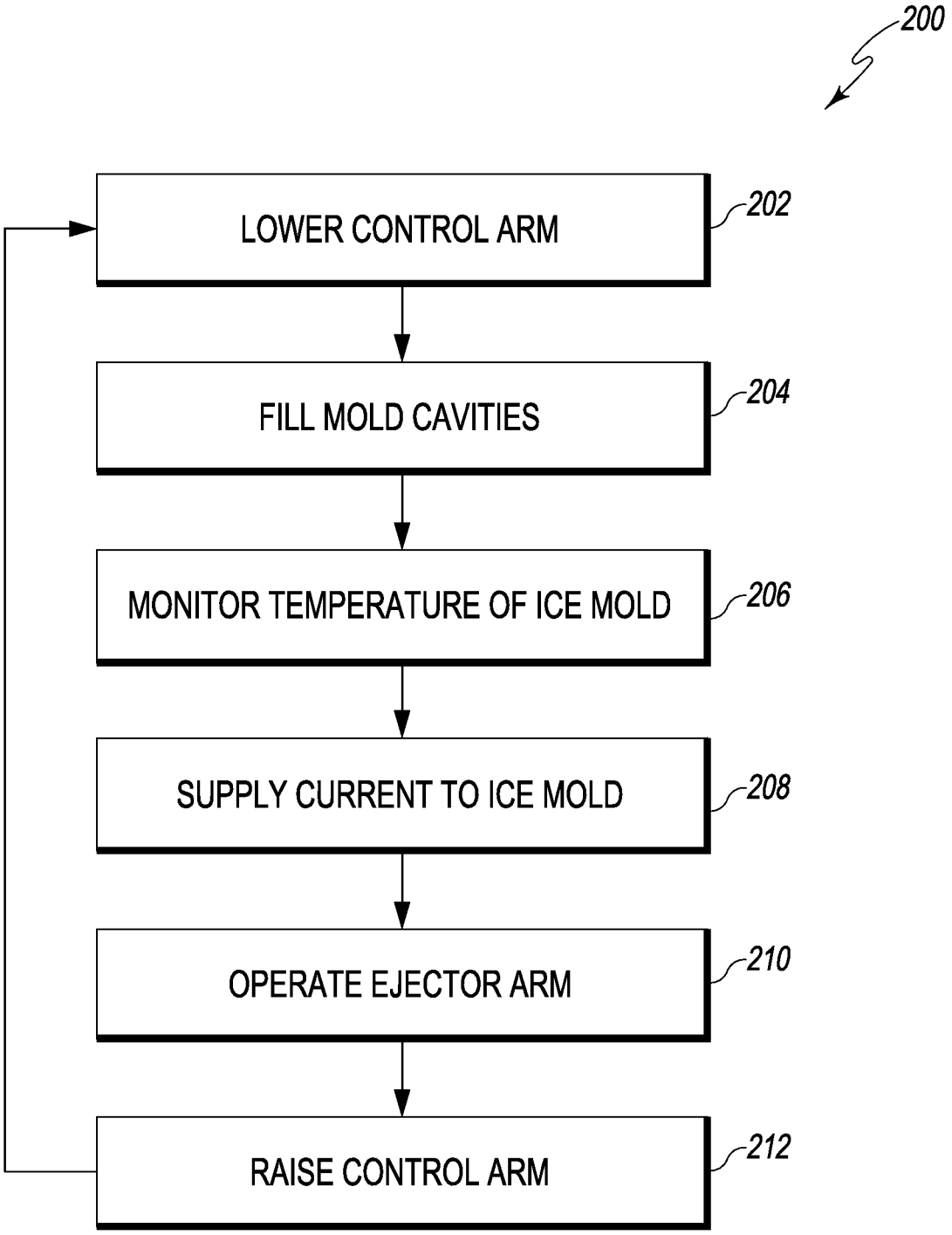
FIG. 4 is a simplified flow chart of an ice production cycle of the ice maker of FIGS. 1-3.

Referring now to FIG. 4, an illustrative embodiment of an ice production cycle 200 of the ice maker 40 is shown. To activate the cycle 200, the control arm 58 of the ice maker 40 is placed in the lowered position (see FIG. 1) in block 202. When the control arm 58 is in the lowered position, the control switch 150 closes, permitting power to be supplied to the other electrical components 154 of the ice maker 40. If the control am 58 is lifted from the lowered position at any time during the ice production cycle, the switch 150 opens to prevent power from being supplied to the other electrical components 154. In that way, the ice production cycle may be interrupted to prevent the production of more ice cubes.

The cycle 200 advances to block 204 after the control arm 58 is placed in the lowered position. In block 204, the timer switch 180 closes such that power is supplied to the solenoid-operated valve 162. When solenoid-operated valve 162 is powered, the valve 162 moves to the open position, and water advances from the fluid line 160 into the feed tube 168. Water advances out of the outlet 170 of the sloped feed tube 168 and into the passageway 176 of the housing 172. Water then advances down the passageway 176 and through the outlet opening 178 of the housing 172 into the compartment 86 of the mold body 70. The cavities 90 of the ice maker 40 are thereby filled with water.

The switch 180 of the ice maker 40 opens after a predetermined period of time has elapsed, thereby preventing power from being supplied to the solenoid-operated valve 162. The solenoid-operated valve 162 moves to the closed position in response to the loss of power, and water is prevented from advancing to the mold body 70 until the beginning of the next ice production cycle. After the cavities 90 are filled with water, the cycle 200 advances to block 206.

In block 206, the thermostat 182 of the ice maker 40 monitors the temperature of the fluid in the cavities 90 of the mold body 70. When the temperature of the fluid in the cavities 90 reaches a predetermined value, the thermostat 182 generates an electrical output signal, which indicates that ice cubes have formed within the cavities 90. The cycle 200 may then advance to block 208.

In block 208, electrical current is supplied to the ice mold 48 to heat the mold body 70 and loosen the ice cubes in the cavities 90. To do so, the timer switch 184 of the ice maker 40 closes in response to receiving the electrical output signal from the thermostat 182. When the switch 184 is closed, electrical power is supplied to the electrodes 72, 74 and the mold body 70. The electrical current advances along the electrodes 72, 74 and passes through the mold body 70, thereby causing the temperature of the electrodes 72, 74 and the mold body 70 to increase. As a result, the surface temperature of the walls 80, 82, 84, 88 surrounding the ice cubes increases and the ice cubes positioned in the cavities 90 loosen from the walls 80, 82, 84, 88 of the mold body 70.

As described above, the electrical conductivity of the mold body 70 decreases as the temperature of the mold body 70 increases such that less current is permitted to pass through the mold body 70. In the illustrative embodiment, when the temperature of the mold body 70 is between about 130° F. and 150° F., the electrical conductivity of the mold body 70 is approximately zero siemens per meter. As a result, substantially no current is permitted to pass through the mold body 70. While current is prevented from passing through the mold body 70, the rate of temperature increase of the mold body 70 slows until the temperature of the mold body 70 begins to decrease.

When the temperature of the mold body 70 drops below the predetermined range of about 130° F. to about 150° F., the conductivity of the mold body 70 increases such that electrical current is again permitted to pass through the mold body 70. The flow of current generates heat, thereby causing the temperature of the mold body 70 to increase and begin the cycle again. In that way, the temperature of the mold body 70 is maintained in the predetermined operating range that corresponds to the temperature required to release the ice cubes from the mold body 70. It should be appreciated that in other embodiments the predetermined temperature range may be between approximately 130° F. and 175° F.

Additionally, in other embodiments, the range may be between approximately 130° F. and 195° F.

As described above, the timer switch 184 is configured to remain closed for a predetermined period of time that approximately corresponds to the time necessary for the ice cubes to be released from the mold body 70. After the predetermined period of time has elapsed, the timer switch 184 of the ice maker 40 opens to prevent power from being supplied to the electrodes 72, 74 and the mold body 7. The cycle 200 may then advance to block 210.

In block 210, the ice cubes are extracted from the cavities 90 of the ice mold 48. To do so, the time delay switch 188 closes after a predetermined period of time has elapsed to permit electrical power to be supplied to the motor 186. In response to receiving the electrical output signal from the thermostat 182, the time delay switch 188 waits a predetermined period of time before closing. As described above, the predetermined period of time may be approximately the same as or greater than the time necessary for the ice cubes to be released from the mold body 70. When the delay switch 188 closes, power is supplied to the motor 186. The motor 186 of the ice maker 40 rotates the ejector arm 62 about the axis 64, thereby advancing the blades 66 into contact with the ice cubes in the cavities 90. The movement of the blades 66 about the axis 64 advances the ice cubes out of the cavities 90 and into the storage bin 44 positioned below the ice maker 40. When the ejector arm 62 completes its revolution, the switch 188 opens to deactivate the motor 186.

It should be appreciated that in other embodiments the motor 186 may be configured to complete an additional rotation or reverse direction. In such embodiments, a blade 66 of the ejector arm 62 may be advanced into contact with an ice cube more than one time in order to force the ice cube to exit the cavity 90. The amount of time the switch 188 remains closed may vary in such embodiments.

In block 212, the ice maker 40 raises the control arm 58 from the lowered position. In the illustrative embodiment, this is accomplished by the ejector arm 62 as the arm 62 rotates about the axis 64. The rotation of the arm 62 advances the arm 62 into contact with the control arm 58 and moves the control arm 58 out of the lowered position. As the ejector arm 62 completes one revolution about the axis 64, the ejector arm 62 releases the control arm 58, thereby permitting the control arm 58 to return to the lowered position and causing the ice maker 40 to repeat the ice production cycle. If the control arm 58 is prevented from returning to the lower position, the ice maker 40 is deactivated.

Figure 5:
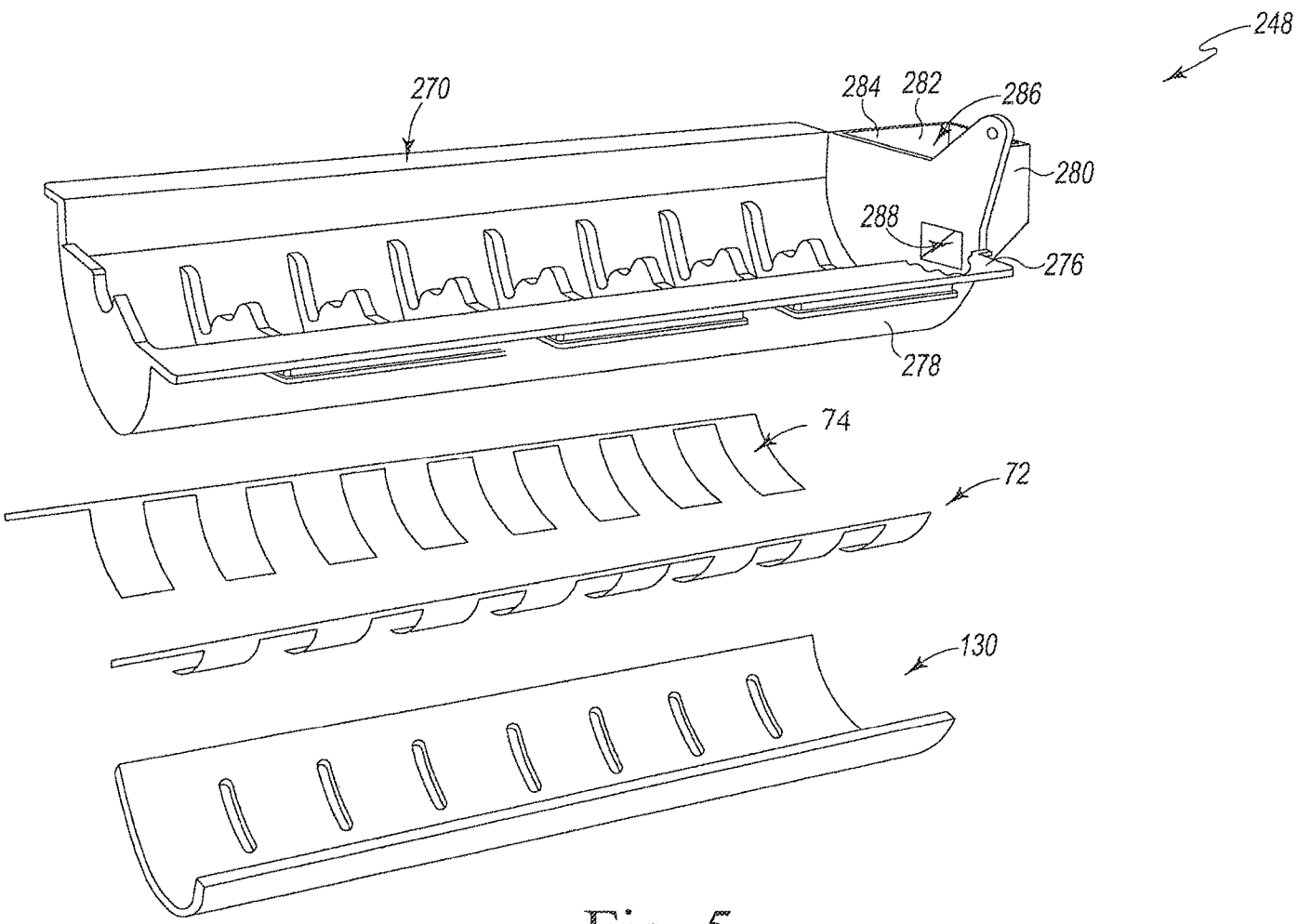
FIG. 5 is an exploded perspective view of another embodiment of an ice mold.

Referring now to FIG. 5, another embodiment of an ice mold (hereinafter ice mold 248) is illustrated. Some features of the embodiment illustrated in FIG. 5 are substantially similar to those discussed above in reference to the embodiment of FIGS. 1-4. Such features are designated in FIG. 5 with the same reference numbers as those used in FIGS. 1-4.

As shown in FIG. 5, the ice mold 248 has a mold body 270, a pair of electrodes 72, 74 secured to the mold body 270, and a cover panel 130 secured to the mold body 70 below the electrodes 72, 74. The mold body 270 is formed from a polymeric material having an electrical conductivity that varies with temperature. In the illustrative embodiment, the polymeric material is selected such that electrical conductivity of the mold body 270 decreases as the temperature of the mold body 270 increases.

The mold body 270 of the ice mold 248 has an upper surface 276 that is positioned opposite a convex bottom surface 278. It should be appreciated that in other embodiments the bottom surface of the mold body may be substantially planar and may include one or more angled surfaces. The mold body 270 includes a pair of end walls 80, 82 that extend downwardly from the upper surface 76. A concave inner wall 84 is positioned between the end walls 80, 82, and the walls 80, 82, 84 define a compartment 86 in the mold body 70. A plurality of divider walls 88 extend upwardly from the concave inner wall 84 to define a plurality of cavities 90 in the mold body 70. Each of the cavities 90 is sized to receive a quantity of fluid corresponding to a single ice cube. In the illustrative embodiment, the mold body 70 has eight cavities 90 defined therein and can therefore concurrently form up to eight ice cubes.

The mold body 270 of the ice mold 248 also includes an integrated fill housing 280 secured to the end wall 82. The fill housing 280, like the fill housing 172, is positioned below the fluid line 160 in the refrigerator 10. The fill housing 280 includes an inlet 282 and an inner wall 284 that extends downwardly from the inlet 282. The inner wall 284 defines a passageway 286 in the housing 280. The housing 280 includes a lower outlet 288 that is positioned adjacent to the compartment 86 of the ice mold 248. When the solenoid-operated valve 162 is moved to the open position, water advances through the outlet 170 of the feed tube 168 into the inlet 282 of the housing 280. Water moves down the passageway 176, out of the outlet 288, and into the compartment 86 defined in the mold body 270 to fill the cavities 90 with water.

In use, the fill housing 280 is heated when the electrodes 72, 74 are connected to the power supply 152 because the fill housing 280 is integrated with the mold body 270. In that way, any ice crystals formed from residue water contained in the passageway 176 are released from the housing 280 and advanced into the compartment 86.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. An ice maker of a domestic refrigerator, the ice maker comprising:

an ice mold including (i) an electrically-conductive polymeric body having a convex bottom surface, and (ii) a plurality of cavities defined in the polymeric body, each cavity being sized to receive a quantity of fluid corresponding to a single ice cube, wherein the polymeric body is configured to contact the fluid when the fluid is received in the plurality of cavities, and a pair of electrodes engaged with the convex bottom surface of the polymeric body, the pair of electrodes being configured to be electrically-coupled to an electrical power supply to heat the polymeric body, wherein (i) the pair of electrodes and the polymeric body define an electrical circuit such that electrical current flows through the polymeric body when the electrical power supply is electrically-coupled with the pair of electrodes, (ii) the polymeric body has a first electrical conductivity at a first operating temperature, and (iii) the polymeric body has a second electrical conductivity that is less than the first electrical conductivity at a second operating temperature, the second operating temperature being greater than the first operating temperature, and wherein:

the polymeric body has a longitudinal axis extending therethrough, the convex bottom surface of the polymeric body has a first surface section positioned on a first side of the longitudinal axis and a second surface section positioned on a second side of the longitudinal axis, and the pair of electrodes includes a first electrode coupled to the first surface section of the convex bottom surface and a second electrode coupled to the second surface section of the convex bottom surface.

2. The ice maker of claim 1, wherein:

the first electrode includes a first plurality of curved plates shaped to conform to the convex bottom surface of the polymeric body of the ice mold, and the second electrode includes a second plurality of curved plates shaped to conform to the convex bottom surface of the polymeric body of the ice mold.

3. The ice maker of claim 1, wherein the pair of electrodes are formed from copper.

4. The ice maker of claim 3, wherein the pair of electrodes are ultrasonically welded to the convex bottom surface of the polymeric body.

5. The ice maker of claim 1, further comprising a panel positioned below the pair of electrodes, the panel having a convex body sized to substantially cover the convex bottom surface of the polymeric body of the ice mold.

6. The ice maker of claim 5, wherein the panel includes a plurality of slots sized to permit passage of air.

7. The ice maker of claim 1, wherein the second electrical conductivity is approximately zero siemens per meter.

8. The ice maker of claim 7, wherein the second operating temperature is between about 130° F. and 150° F.

9. An ice maker of a domestic refrigerator, the ice maker comprising:

an ice mold including (i) an electrically-conductive polymeric body having a bottom surface, and (ii) a plurality of cavities defined in the polymeric body, each cavity being sized to receive a quantity of fluid corresponding to a single ice cube, wherein the polymeric body is configured to contact the fluid when the fluid is received in the plurality of cavities, a first copper electrode coupled to the bottom surface of the polymeric body, the first copper electrode including a first plurality of plates shaped to conform to the bottom surface, and a second copper electrode coupled to the bottom surface of the polymeric body, the second copper electrode including a second plurality of plates shaped to conform to the bottom surface, wherein (i) the first copper electrode, the second copper electrode, and the polymeric body define an electrical circuit such that electrical current flows through the polymeric body when power is supplied to the electrical circuit to heat the polymeric body and release ice cubes formed therein, (ii) the polymeric body has a first electrical conductivity at a first operating temperature, and (iii) the polymeric body has a second electrical conductivity that is less than the first electrical conductivity at a second operating temperature, the second operating temperature being greater than the first operating temperature, and wherein the polymeric body has a longitudinal axis extending therethrough that is positioned between the first copper electrode and the second copper electrode.

10. The ice maker of claim 9, further comprising a tube in fluid communication with a fluid reservoir, the tube having an outlet positioned above the polymeric body, wherein the polymeric body of the ice mold includes (i) an upper surface having the plurality of cavities defined therein, and (ii) a housing having a first opening positioned below the outlet of the tube and a second opening position above the upper surface such that fluid from the fluid reservoir is advanced to the plurality of cavities.

11. The ice maker of claim 10, further comprising a panel positioned below the first copper electrode and the second copper electrode, the panel being sized to substantially cover the bottom surface of the polymeric body of the ice mold.

12. The ice maker of claim 11, wherein the panel includes a plurality of slots sized to permit passage of air.

13. The ice maker of claim 9, wherein the first plurality of plates of the first copper electrode and the second plurality of plates of the second copper electrode correspond to the plurality of cavities defined in the polymeric body of the ice mold.

14. The ice maker of claim 9, wherein the second electrical conductivity is approximately zero siemens per meter.

15. The ice maker of claim 14, wherein the second operating temperature is between about 130° F. and 150° F.

16. A method of operating an ice maker for a domestic refrigerator, comprising:

supplying fluid to an electrically-conductive polymeric body having a convex bottom surface such that the fluid is received in at least one cavity of a plurality of cavities defined in the polymeric body, each cavity being sized to receive a quantity of the fluid corresponding to a single ice cube, wherein the fluid is in contact with the polymeric body, electrically coupling a pair of electrodes engaged with the convex bottom surface of the polymeric body to an electrical power supply to heat the polymeric body, the pair of electrodes and the polymeric body defining an electrical circuit, increasing an operating temperature of the polymeric body after at least one ice cube is formed in the at least one cavity to release the at least one ice cube from the polymeric body, wherein increasing the operating temperature includes causing electrical current to flow through the polymeric body when the electrical power supply is electrically-coupled with the pair of electrodes, and extracting at least one ice cube from the at least one cavity of the polymeric body, wherein (i) the polymeric body has a first electrical conductivity at a first operating temperature, and (ii)

the polymeric body has a second electrical conductivity that is less than the first electrical conductivity at a second operating temperature, the second operating temperature being greater than the first operating temperature, and wherein:

the polymeric body has a longitudinal axis extending therethrough, the convex bottom surface of the polymeric body has a first surface section positioned on a first side of the longitudinal axis and a second surface section positioned on a second side of the longitudinal axis, and the pair of electrodes includes a first electrode coupled to the first surface section of the convex bottom surface and a second electrode coupled to the second surface section of the convex bottom surface.

17. The method of claim 16, wherein the second electrical conductivity is approximately zero siemens per meter.

18. The method of claim 17, wherein the second operating temperature is between about 130° F. and 150° F.

* * * * *